United States Patent [19]

Foster et al.

[11] 4,456,164

[45] Jun. 26, 1984

[54] DELIDDABLE OVENABLE CONTAINER

[75] Inventors: Peter D. Foster, Waterville; Clifford Stowers, Fairfield, both of Me.

[73] Assignee: Keyes Fibre Company, Waterville, Me.

[21] Appl. No.: 379,359

[22] Filed: May 18, 1982

[51] Int. Cl.[3] ..... B65D 5/64; A21D 10/02

[52] U.S. Cl. ..... 229/43; 206/631; 229/2.5 R; 428/35; 428/194; 426/113

[58] Field of Search ..... 426/113, 114, 123; 428/194, 35; 229/2.5 R, 43; 206/631, 633, 484

[56] References Cited

U.S. PATENT DOCUMENTS

| | | | |
|---|---|---|---|
| 2,113,927 | 4/1938 | Alfred | 426/123 |
| 2,649,392 | 8/1953 | Marshall | 154/83 |
| 2,990,948 | 7/1961 | Zackheim | 206/46 |
| 3,083,821 | 4/1963 | Woodson | 206/47 |
| 3,783,089 | 1/1974 | Hurst et al. | 426/123 |
| 3,836,679 | 9/1974 | Seiferth et al. | 426/129 |
| 3,865,302 | 2/1975 | Kane | 426/113 |
| 3,910,410 | 10/1975 | Shaw | 206/363 |
| 3,924,013 | 12/1975 | Kane | 426/523 |
| 3,997,677 | 12/1976 | Hirsch et al. | 426/113 |
| 4,147,836 | 4/1979 | Middleton et al. | 426/113 |
| 4,261,504 | 4/1981 | Cowan | 229/43 |
| 4,337,116 | 6/1982 | Foster et al. | 162/158 |

FOREIGN PATENT DOCUMENTS 929455 7/1973 Canada .

OTHER PUBLICATIONS

DuPont brochure "Oven-Lovin' Mylar®", E-33724, 2/81, (5 pp.).

Article "Innovations", (Source uncertain, handwritten date 3/14/80), (2 pp.).

3M brochure, "Scotchpak® Strippable-Ovenable Lid Film", #5850, 7/1/78, (2 pp.).

*Primary Examiner*—William R. Dixon, Jr.

*Attorney, Agent, or Firm*—Connolly and Hutz

[57] ABSTRACT

A deliddable ovenable container, such as a molded pulp tray with a liner obtained from a thin film of polyester, useful for packaging food to be frozen for sale and storage and subsequently heated by the consumer in either a microwave or a conventional oven, with means to insure that a transparent and flexible lid of polyester film sealed thereto by heat and pressure subsequently can be peeled away from the polyester liner of the tray without any undesirable delamination of the liner from the molded pulp base of the tray, either at freezing temperatures before heating or at high temperatures after heating, to expose the food for consumption. Such means includes a coating of release material having adhesive properties, such as methyl cellulose, on the liner outside the area where the lid is to be sealed to prevent strong adherence between the lid and the liner at the extreme edges of the tray, the release material ideally having fiber adhesive properties as well and being applied to the cut edge which strengthens the mechanically trimmed fibrous material around the edge of the molded pulp base, plus increased density of the fibrous material only around the zone of the release material and the lid seal so that the fibrous material additionally resists being pulled apart in that area while still providing a thicker thus stronger tray elsewhere which resists bending forces.

13 Claims, 7 Drawing Figures

DELIDDABLE OVENABLE CONTAINER

BACKGROUND OF THE INVENTION

This invention relates to a field of packaging containers, such as dished trays for products such as food or the like, which comprise a base of fibrous material such as molded pulp or pressed paperboard, having bonded to one side thereof an impervious liner of polymeric material, which is designed to have a lid of transparent flexible plastic material, such as a film of heat sealable polyester, hermetically sealed around the edges thereof by heat and/or pressure, and wherein the lid is to be physically pulled away and removed from the container by the ultimate consumer to expose for consumption the food or other product packaged in the container.

Trays of this type are replacing trays made of metal such as aluminum foil in the frozen meal industry, for instance, because of their superiority in several respects, particularly their utility with the increasingly prevalent home microwave ovens.

This invention is particularly useful with previously shaped ovenable molded pulp trays having a liner obtained from a film of polyester of the type described in Foster and Stowers U.S. Pat. No. 4,337,116 (June 1982), the complete disclosure of which is incorporated herein by this specific reference thereto. Many aspects of this invention also may be useful with ovenable trays mechanically shaped from paperboard previously coated or lined with polyester, of the type disclosed in Kane U.S. Pat. No. 3,924,013 (December 1975). While the aforesaid disclosures relate to ovenable containers useful with food for human consumption, many aspects of the present invention also will prove useful, it is now believed, with other packaging containers for other end uses where undesirable delamination of the container when attempting to remove the lid therefrom presents a problem.

The problem heretofore unresolved by the prior art is most severe and thus best explained with respect to containers which comprise a base molded to substantially finished shape of fibrous pulp material, to which a liner from a film of polyester is bonded by heat and pressure. To receive a lid, such containers conventionally have a marginal portion surrounding a central portion where the product is packaged, the marginal portion taking the form of a lateral flange defining the outer periphery of the container. When a lid of transparent flexible material, such as a thin heat sealable polyester film, is tightly sealed by heat and pressure to the liner of the container around the lateral flange, then that lid seal may be stronger than either the bond between the liner and the molded pulp base, or the interfelted bond between the fibers of the molded pulp base itself.

When the lid seal is stronger than either of these bonds, then attempts to physically pull the lid away and separate it from the container are defeated because the lid remains sealed to the liner around the packaged product, and the liner of the container delaminates from the molded pulp base, usually with some fibrous pulp still bonded to the underside thereof. This retains the sealed envelope relationship of the lid and the liner around the packaged product, without exposing the product for removal from the container as desired for its intended end use.

This delidding problem is not as critical with containers shaped from a base of flat paperboard having a polyester coating extruded thereon, at least at present, because the more densely interfelted bond between the fibers of the pressed paperboard resist pulling apart to the point where a lid of polyester film sealed thereto may be stripped from the polyester coating with less force than it takes to delaminate the coating from the paperboard or the fibers of the paperboard itself. The paperboard bases of such containers are of necessity densely compacted throughout, however, which in turn dictates that the overall container is quite flexible or flimsy, and is only marginally strong enough to provide a commercially acceptable container of an appropriate size to hold products as heavy as frozen meals. The development of polyester lined ovenable containers utilizing a molded pulp base as described in the aforesaid Foster and Stowers patent, which have much greater overall strength for a given weight than a tray utilizing a pressed paperboard base, however, may well require that manufacturers of paperboard-based containers will be compelled to provide a much thicker and less dense base to meet competitive strength requirements. This change inevitably will create delamination upon delidding problems in paperboard based trays analogous to those now encountered with molded pulp based containers, as explained above, and thus it is now believed that the present invention ultimately will find favor with manufacturers of containers shaped from polyester coated paperboard.

Thus, the problem heretofore unresolved by the prior art is to provide a container, such as a food tray, comprising a relatively strong base of fibrous material having bonded to one side thereof a liner of polymeric material, capable of withstanding freezer-to-oven temperatures and times, wherein a lid sealed to the marginal portion of the container can be peeled away from the liner and fully separated from the container manually (physically, with the hands) without adversely affecting the fibrous material of the base or the bond between the liner and the base, at any temperature within that range, to easily and cleanly expose the packaged food or other product for its intended end use.

SUMMARY OF THE INVENTION

This invention comprises a liddable packaging container having a relatively thick base of fibrous material such as molded pulp or pressed paperboard with a relatively thin liner of polymeric material bonded thereto, capable of withstanding temperatures ranging from below freezing for months on end up to temperatures as high as about 400° F. for times of at least about 15 minutes (or as long as 45 minutes when filled with food or the like which is frozen at the outset), with a coating of release material having polyester-abhesive properties on the marginal portion outside the area where a lid is to be sealed to insure that the lid seal subsequently can be overcome and the lid fully and cleanly separated from the liner manually without adversely affecting the fibrous material of the base or the bond between the liner and the base at any temperature within the aforesaid range, ideally in combination with release material which also has fiber-adhesive properties and which penetrates and strengthens the fibrous material at the edge of the container, and/or with fibrous material which has been compacted and densified around the edge of the container in the zone of release material and the lid seal to a much greater extent than the fibrous material of the rest of the container.

BRIEF DESCRIPTION OF THE DRAWINGS

Numerous advantages of the present invention will be readily apparent to one skilled in the art from a reading of the detailed description in conjunction with the accompanying drawings wherein similar reference characters refer to similar parts, and in which.

DETAILED DESCRIPTION OF THE INVENTION

Figure 1:
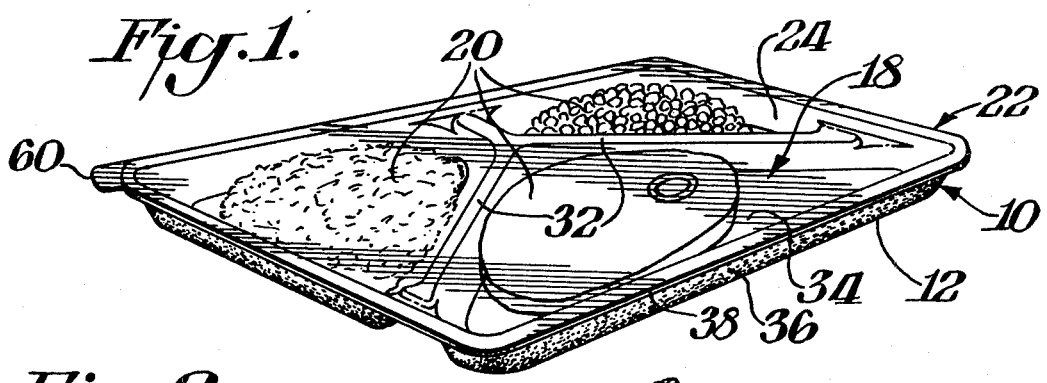
FIG. 1 is a pictorial view of a polyester lined food packaging container in the form of a tray, with food products packaged in the central portion thereof, and a flexible transparent lid of polyester heat sealed around the marginal portion of the tray to contain, enclose and protect the food.
Figure 6:
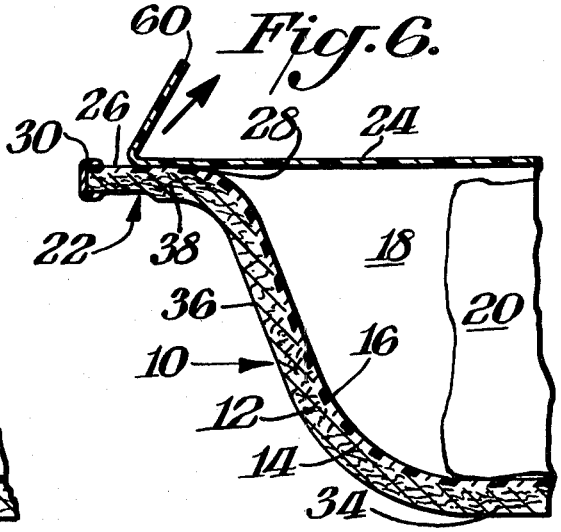
FIG. 6 is an enlarged fragmentary sectional elevational view showing the successful separation of a lid from the container to cleanly expose the packaged product without delaminating the container, according to this invention; and, FIG. 7 (Prior Art) is an enlarged fragmentary sectional elevational view showing the unacceptable fiber-from-fiber delamination which occurs when attempting to separate a tightly sealed lid from the liner of the container without benefit of the present invention.

The liddable packaging container 10 according to this invention, and with particular reference to FIGS. 1 and 6, comprises a relatively thick base 12 of fibrous material, having bonded as at 14 to the inner or upper or "product" side thereof a relatively thin liner 16 of polymeric material. The container 10 includes a central portion 18 for accommodating a product 20 to be packaged therein, surrounded by a marginal portion 22 for accommodating a lid 24 to contain the product 20. The marginal portion 22 includes a surface 26 to which the lid 24 can be sealed as at 28 directly to the liner 16.

The container 10 further includes a coating 30 of release material on the marginal portion 22, outside the area where the lid 24 is sealed as at 28 to the liner 16, to insure that the lid seal 28 can be overcome and the lid 24 separated, fully as a single piece without tearing, from the liner 16 of the container 10, manually by gripping with the fingers and pulling upwardly and across the container, without adversely affecting either the polymeric material of the liner 16, or the fibrous material of the base 12, or the bond 14 between the liner 16 and the base 12, or the product 20 packaged therein.

A relatively thick base 12 according to the preferred embodiment of the present invention is obtained by molding fibrous pulp from an aqueous slurry thereof against an openface suction mold to a generally finished and three-dimensionally contoured shape, after the well-known fashion. The damp molded shape is then dried, preferably according to the precision molding process wherein it is dried under pressure imposed by a mating pair of heated dies. Alternately, the molded shape may be dried by the rough finish process wherein it is dried in a hot air oven, with or without a form to help it retain its shape during the drying process. Whichever drying process is used, such molded pulp bases may be nested one within another in a stack thereof for compact storage and convenient mechanized feeding to film laminating equipment for bonding the polyester liner thereto.

The relatively thick base 12 of fibrous material also may be obtained from a sheet of pressed fibrous paperboard. If such a container is to have a three-dimensionally contoured shape, the flat sheet of paperboard may be either folded up, or press formed, to obtain the desired shape, as explained in the aforesaid Kane patent. Other ways to obtain a relatively thick base of fibrous material are within the knowledge of those skilled in the art.

The relatively thin liner 16 of polymeric material for the container similarly may be provided after the known fashion. According to the preferred embodiment, where the base is molded pulp, the liner may be obtained from a thin film of polymeric material, as described in the aforesaid Foster and Stowers patent. A similar liner may be applied to a folded up or press formed base of plain paperboard from a thin film of polymeric material using an equivalent process. Alternatively, when using a paperboard base, the polymeric material may be coated on the flat paperboard from a hot liquid melt of the polymeric material and then cooled and dried before the same is folded up or press formed into the final three-dimensionally contoured shape, as described in the aforesaid Kane patent.

Whichever of the foregoing procedures is used to provide a relatively thick base of fibrous material having bonded to one side thereof a relatively thin liner of polymeric material, it is important to insure that the base 12 and the liner 16 and the bond 14 between them are capable of withstanding temperatures ranging from below freezing for months on end up to temperatures as high as about 400° F for times of at least about 15 minutes, and as long as about 45 minutes in situations where the container and its packaged contents are frozen at the outset. Containers using the materials and methods described in the aforesaid Kane patent for trays with a pressed paperboard base, and in the aforesaid Foster and Stowers patent for trays with a molded pulp base, fully meet these temperature and time requirements. In containers made according to the Kane patent the liner is obtained from a melt of polyethylene terephthalate extruded on the flat paperboard before shaping, and in containers made according to the Foster and Stowers patent the liner is obtained from a thin film of substantially amorphous and substantially unoriented polyethylene terephthalate or the equivalent bonded by heat and pressure to the previously shaped pulp base.

The container 10 includes a central portion 18 for accommodating a product 20 to be packaged therein, and in the preferred embodiment illustrated in the drawings this includes a downwardly dished portion, which may include dividing ribs 32. The downwardly dished central portion 18 ordinarily will include a relatively flat bottom 34, with or without logos or other decorative or functional configurations embossed therein, with upwardly sloping side walls 36, which merge with the marginal portion 22. The sloping walls, without any substantially vertical wall portions, permit a plurality of like empty trays to be nested one within another in a stack thereof for compact shipment, rugged storage, and convenient mechanized feeding to food-filling stations.

In the preferred embodiment, the marginal portion 22 takes the form of a lateral flange 38 defining the outer periphery of the container. To facilitate sealing the lid 24 to the sealing surface 26, the lateral flange 38 should lie in a substantially flat plane. With lined containers having a molded pulp base, the flange can easily be made absolutely smooth or flat to facilitate a hermetic seal for the lid. With lined containers having a base shaped from paperboard, the inevitable pleats and folds and/or creases make it difficult to provide such an absolutely flat planar lid sealing surface.

Figure 2:
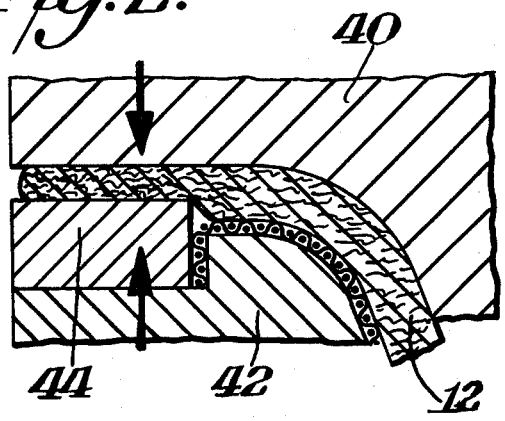
FIG. 2 is a greatly enlarged and somewhat schematic fragmentary sectional elevational view showing the manner in which the marginal lateral flange of a three-dimensionally shaped molded pulp base for the container may be compacted by mechanical pressure during manufacture to densify the fibrous material.

The manner in which the marginal portion 22 of a container according to the present invention is improved to insure proper removal of a lid subsequently applied thereto is best described with reference to FIGS. 2 through 5, as arranged in counter-clockwise fashion. In FIG. 2, the fibrous material of a molded pulp base 12 is illustrated as being dried according to the precision molding process under pressure imposed by a mating pair of heated dies, consisting of an upper male die 40 with a polished metal surface, and a lower female die 42 with a screen covered surface. The mating dies 40, 42 are pressurized toward each other, as indicated by the directional arrows, to squeeze water out of the damp fibrous material, in a high temperature environment. The lower die 42 is provided with a raised insert 44 around the under-side of the lateral flange, so that the flange portion of the base will be compacted by such mechanical pressure to make it denser than the fibrous material of the rest of the base. An insert similar to the raised insert 44 may with equal facility be provided to the upper die 40, either instead of or in cooperation with the insert 44, depending on heating parameters for the dies and the desired shape or smoothness of the upper surface of the flange.

This mechanical compaction insures that the densified fibrous material of the flange will be characterized by tightly interfelted and well bonded fibers which tenaciously resist being pulled apart, whereas the less dense rest of the base 12 will be characterized by openly interfelted fibers. The openly interfelted fibers maintain an overall rigidity, and provide strength against the type of bending forces to which the container itself may be subjected. The increased density of the fibrous material of the flange helps insure that a lid subsequently sealed to the container can be fully separated without adversely effecting the lamination or bond between the fibers of the flange. When the lateral flange is compacted in this fashion by mechanical pressure while the base is being dried, the thickness of the flange accordingly will be reduced, so that it is no more than about two-thirds the thickness of the rest of the base in the now preferred embodiment.

Figure 3:
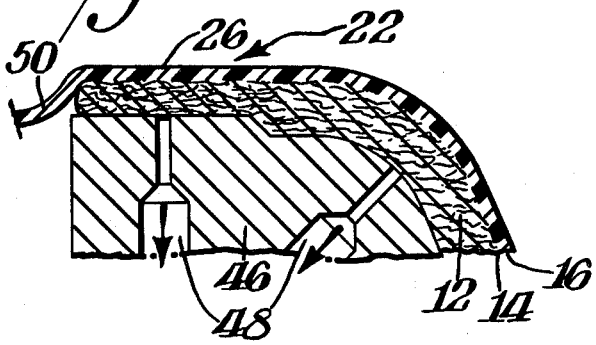
FIG. 3 is a similarly enlarged sectional elevational view showing how the relatively thin liner may be bonded to such a molded pulp base from a film of thermoformable polymeric material.

In FIG. 3, the general process for bonding a relatively thin liner of polymeric material to one side of a molded pulp base 12 is illustrated in somewhat schematic fashion, with the thickness of the film of polymeric material exaggerated for purposes of illustration. The bonding process is described in the aforesaid Foster and Stowers patent, and it consists very generally of the steps of placing a molded pulp base 12 in a heated back-up die 46, which is equipped with means 48 for drawing a vacuum through a molded pulp base placed therein. The heated die 46 pre-heats the molded pulp base 12 to a desired temperature, so that the upper surface of the base is at the desired bonding temperature. A film 50 of polymeric material, such as a thin film of substantially amorphous and substantially unoriented polyethylene terephthalate, is placed in close proximity above the pre-heated base 12, and the film is rapidly preheated. As soon as the film 50 is pre-heated to the desired bonding temperature, vacuum is applied through the molded pulp base, by means of the vacuum ports 48, to quickly draw the film into conformity with the three-dimensionally contoured shape of the molded pulp base, and bond the under-side of the film to the upper layers of fibrous material of the base. This forms a generally integral liner of polymeric material on the molded pulp base, being generally impermeable and suitable for freezer-to-oven food trays. Preferably, the film 50 has a greater area than the outer edge of the densified flange 22 of the container, so that some of it over-hangs the flange after the film laminating step has been completed.

The flat flange illustrated in connection with the preferred embodiment does not exclude the use of a generally level flange wherein some or all of the outermost periphery is angled downwardly, or upwardly, for either decorative or functional purposes.

Figure 4:
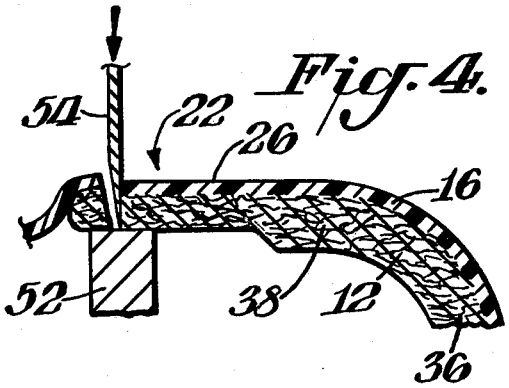
FIG. 4 is a similarly enlarged sectional elevational view showing how the lined base may be mechanically trimmed to establish a clean and uniform outer edge of the densified flange around the container.

FIG. 4 shows how the generally rough edge of the flange and the over-hanging excess of film may be mechanically trimmed to establish the final outer edge of the flange around the container, whether or not the flange has been densified as aforesaid in connection with FIG. 2. The lined base may be placed on a back-up ring 52, properly oriented, whereupon a sharp trimming member 54 may be caused to move downwardly to the ring 52 to sever the excess film and molded pulp, establishing a neatly trimmed and dimensionally uniform outer edge for the container. Other well known edge trimming techniques may be used without defeating the objectives of the present invention.

Figure 5:
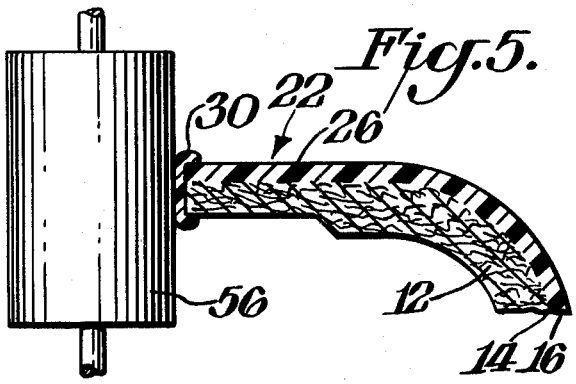
FIG. 5 is a similarly enlarged sectional elevational view showing how the release material may be applied to the liner around the outer periphery of the flange, as well as to the fibrous material of the base at the trimmed outer edge of the flange.

Thereafter, with reference to FIG. 5, the release material according to this invention may be applied to the marginal portion of the container 10. This may be accomplished by means of a roller 56 coated with the release material in a liquid form, which is moved laterally relative to the container 10 so that a bead of liquid release material is applied around the trimmed outer edge of the densified flange, as at 30. In FIGS. 5 and 6, the thickness of the coating 30 of release material is greatly exaggerated, simply for clarity of illustration, whereas in practice such liquid coating may be extremely thin indeed. As best seen in FIG. 5, the coating 30 of release material is on the marginal portion, outside the area 26 where the lid is to be sealed. Namely, the coating of release material is on the upper surface of the liner 16, at the outer periphery of the flange 38, and the lid sealing surface 26 is inside that marginal coating.

In addition, as also seen in FIG. 5, the coating of release material as applied by the roller 56 extends outwardly past the trimmed edge of the liner 16, and around the outer edge of the flange, so that it may penetrate to some extent the trimmed fibrous material of the molded pulp base 12 at the outer edge. As can be seen, the coating of release material not only extends past the liner and around the outer edge of the flange, but also coats the other or underside of the base 12 around the under-side of the densified flange 38, although this does not substantially promote the benefits of the invention as presently understood. Only a single tray is shown in FIG. 5, but it should be self-evident that a nested stack of trays may be presented to an elongated roller so that the release material is applied to a plurality of trays simultaneously, provided their outer edges have been trimmed in a manner which makes them dimensionally uniform.

The release material preferably is one which may be applied in liquid or paste form, as aforesaid, and which will dry rapidly to a solid which has abhesive properties which prevent severe adhesion between the lid and the liner of the container. Many known polyester-abhesive materials are in this category, but the preferred materials will stick to the liner, as well as to the lid which is applied thereover, so as to provide a modest seal between the lid and the liner. Upon attempts to physically separate the lid from the liner, however, such materials should be easily overcome, so that the lid may be easily peeled back away from the extreme edges of the container liner. This insures a more extensive lateral bond between the liner and the base than the extent of the direct seal between the lid and the liner, so that the strong but almost linearly narrow hermetic seal directly between the lid and the liner may be overcome without adversely effecting the fibrous material of the base, or the bond between the same and the liner, and the lid cleanly removed in one piece without tearing.

Suitable release materials within this category include materials selected from the group which includes cellulose ethers such a methyl cellulose, hydroxy propyl cellulose, hydroxy ethyl cellulose, carboxy methyl cellulose, and polymeric silicones, alginates, starch, starch derivatives and blends or mixtures thereof.

According to the preferred embodiment of this invention, the release material in addition to polyester-abhesive properties should have fiber-adhesive properties, so that the material which is applied to the vertical outer edge of the container will penetrate the trimmed fibrous material, at least to some extent, and strengthen the fibers and the bond between them at the outer edge to further resist fiber-from-fiber separation in the upper layers adjacent the liner which is bonded thereto.

In addition to release materials which have abhesive propeties as applied between the polyester liner and a lid of material which may be sealed to the polyester liner, plus adhesive properties as applied to the mechanically trimmed fibrous material at the outer edge of the densified flange, the release materials should have other properties when the container is to be used with food for human consumption. Namely, the release material should be characterized by an absence of deleterious odor, taste, toxicity and similar characteristics, as well as a resistance to crumbling or flaking which could physically contaminate the food packaged in the container. Ideally, the release material should have such characteristics at any temperature from below freezing for months on end up to temperatures as high as about 400° F. for times of at least about 15 minutes. For aesthetic purposes, furthermore, the coating of release material, being extremely thin, should be virtually colorless, and the release material itself should not cause any chemical reaction which would adversely affect the coloration of either the liner of polymeric material, of the lid of polymeric or other material, or the direct seal between the lid and the liner at any temperature within the aforesaid range.

Figure 7:
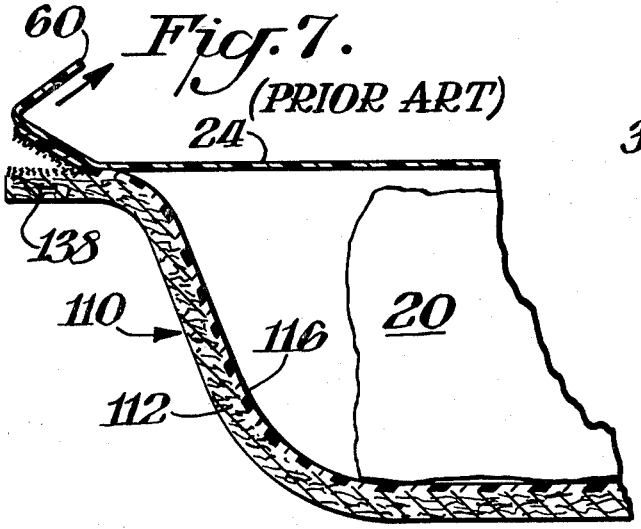
Fig. 7. (PRIOR ART)

A container made according to the foregoing disclosure will solve a delidding problem encountered with trays known from prior art such as the Foster and Stowers patent, such problem being illustrated in FIG. 7. FIG. 7 illustrates, in somewhat schematic fashion, a prior art packaging tray 110 consisting of a relatively thick base 112 of fibrous material having bonded to the upper side thereof a relatively thin liner 116 of polyester material, with a food product 20 packaged in the central portion thereof. A lid 24 consisting of a thin film of polyester has been sealed by heat and pressure directly to the liner 116 around the lateral flange 138. As shown in the drawings, the lid 24 may include a pull tab extension 60 at one corner, which over-hangs the flange 138 at the corner, to provide finger grip access to start peeling the lid 24 away from the container 110. As seen in FIG. 7, without the release material or the densified flange accordingg to this invention, the direct seal between the lid 24 and the container liner 116 is stronger than the interfelted bond between the molded fibrous material, and manual separation forces applied as at the pull tab 60 simply peel the container liner upwardly with the lid 24, delaminating the fibrous pulp material of the base 112 in the process. This destroys the tray 110, and does not open the envelope relationship between the lid sealed to the liner around the packaged product 20, and does not expose the product for its intended end use.

With a tray accordingg to the present invention, including the coating 30 of release material and the densified fibrous material at the flange, however, manual separation forces applied as at the pull tab 60 successfully peels the lid 24 away from the container liner 16 without adversely affecting the liner or the fibrous material of the base 12, or the bond 14 between the liner and the base, as illustrated in FIG. 6. This is true whether the lid is removed when the tray and its contents are below freezing, prior to heating, or they are at a temperature as high as about 400° F., after heating. Thus, with a tray according to this invention, the lid 24 can be removed from the container 10 easily and in one piece, without danger of delaminating the container itself, so as to expose the packaged food or other product 20 undamaged for its intended end use.

While the above described embodiments constitute the preferred mode of practicing this invention, other embodiments and equivalents may be resorted to within the scope of the actual invention, which is claimed as:

1. A liddable packaging container comprising a relatively thick base of fibrous material having bonded to at least one portion of one side thereof a relatively thin liner of polymeric material, the base and the liner and the bond between them being capable of withstanding temperatures ranging from below freezing up to as high as about 400° F., the container including a central portion for accommodating a product to be packaged therein surrounded by a marginal portion for accommodating a lid to contain the product, the marginal portion including a surface to which a lid can be sealed to the liner, the lid and the seal between the lid and the liner also being capable of withstanding temperatures within the aforesaid range, and a coating of release material on the marginal portion outside the area where the lid is to be sealed to insure that the seal can be overcome and the lid fully separated from the liner of the container manually without adversely affecting either the polymeric material of the liner or the fibrous material of the base or the bond between the liner and the base at any temperature within the aforesaid range.

2. A container as in claim 1 wherein the marginal portion takes the form of a lateral flange defining the outer periphery of the container, the coating of release material is on the liner at the outer periphery of the flange, and the lid sealing surface is inside the outer periphery and substantially continuous around the product accommodating portion of the container.

3. A container as in claim 2 wherein the lid sealing surface of the lateral flange lies in a substantially flat plane.

4. A container as in claim 3 wherein the container including the release material is compatible with use with food for human consumption, without deliterious odor, taste, toxicity or physical contamination at any temperature within the aforesaid range.

5. A container as in claim 4 wherein the coating of release material is virtually colorless, and the release material itself does not have any adverse affect on the coloration of either the liner or the lid or the seal therebetween at any temperature within the aforesaid range.

6. A container as in claim 5 wherein the release material is selected from the group which includes methyl cellulose, hydroxy propyl cellulose, hydroxy ethyl cellulose, carboxy methyl cellulose, and polymeric silicones, alginates, starch, starch derivatives and blends or mixtures thereof.

7. A container as in claim 2 wherein the coating of release material extends past the liner and around the outer edge of the flange, and the release material has adhesive properties which serve to strengthen the fibrous material of the base.

8. A container as in claim 2 wherein the fibrous material of the flange portion of the base has been compacted by mechanical pressure so that it is denser than the fibrous material of the rest of the base, the increased density further insuring that the seal can be overcome and the lid fully separated from the liner of the container manually without adversely affecting either the fibrous material of the base or the bond between the liner and the base.

9. A container as in claim 8 wherein the lateral flange of the base is no more than about two-thirds the thickness of the rest of the base, and the coating of release material extends past the liner and around the outer edge of the flange and to the other side of the base.

10. A container as in claim 9 wherein the base is obtained by molding fibrous pulp from an aqueous slurry thereof against an open-face suction mold to a generally finished and three dimensionally contoured shape, and then drying the pulp under pressure imposed by a mating pair of heated dies, the liner is obtained from a film of the polymeric material, the lined base has been mechanically trimmed to establish the outer edge of the densified flange around the container, the coating of release material extends past the liner and around the trimmed outer edge, and the release material penetrates the trimmed fibrous material at the outer edge.

11. A container as in claim 10 wherein the densified flange is characterized by tightly interfelted fibers which resist being pulled apart, whereas the less dense rest of the base is characterized by openly interfelted fibers which maintain rigidity and resist overall bending forces to which the rest of the container may be subjected.

12. A container as in claim 10 wherein the release material further has adhesive properties which serve to strengthen the densified and trimmed fibrous material at the outer edge.

13. A container as in claim 10 wherein the liner is obtained from a film of substantially amorphous and substantially unoriented polyethylene terephthalate, and the release material is methyl cellulose.

* * * * *